US009307847B2

(12) United States Patent
De Lecce

(10) Patent No.: US 9,307,847 B2
(45) Date of Patent: Apr. 12, 2016

(54) JEWELRY DETENTION SYSTEM AND METHOD

(71) Applicant: Giuliano De Lecce, Carmel Valley, CA (US)

(72) Inventor: Giuliano De Lecce, Carmel Valley, CA (US)

( * ) Notice: Subject to any disclaimer, the term of this patent is extended or adjusted under 35 U.S.C. 154(b) by 0 days.

(21) Appl. No.: 13/941,274

(22) Filed: Jul. 12, 2013

(65) Prior Publication Data

US 2013/0299363 A1 Nov. 14, 2013

Related U.S. Application Data

(63) Continuation-in-part of application No. 12/931,690, filed on Feb. 8, 2011, now Pat. No. 8,607,970.

(51) Int. Cl.

| | |
|---|---|
| ***A45C 11/04*** | (2006.01) |
| ***A47F 3/14*** | (2006.01) |
| ***A47F 7/024*** | (2006.01) |

(52) U.S. Cl.
CPC .. *A47F 3/14* (2013.01); *A47F 7/024* (2013.01)

(58) Field of Classification Search
CPC ..... A47F 7/024; A47F 3/14
USPC ..... 206/6.1, 566, 560, 565, 807; 24/3.1; 211/85.2; 312/107
See application file for complete search history.

(56) References Cited

U.S. PATENT DOCUMENTS

| | | | | |
|---|---|---|---|---|
| 1,063,662 | A * | 6/1913 | Dahl | 206/560 |
| 4,074,637 | A * | 2/1978 | Lorenzen, Jr. | 206/566 |
| 4,120,401 | A * | 10/1978 | Newman | 206/566 |
| 5,358,099 | A * | 10/1994 | Tavone | 206/6.1 |
| 5,685,436 | A * | 11/1997 | Davet | 211/163 |
| 6,158,578 | A * | 12/2000 | Greiner | 206/6.1 |
| 7,654,399 | B2 * | 2/2010 | Scholen et al. | 211/26 |
| 8,292,097 | B2 * | 10/2012 | Goldberg | 211/85.2 |

* cited by examiner

*Primary Examiner* — Mickey Yu
*Assistant Examiner* — Chun Cheung

(57) ABSTRACT

A device for displaying jewelry having a retractable cord positioned beneath a jewelry display pad, wherein the cord passes through a slot in the display pad and is securely attached to an item of jewelry to be displayed on the display pad, and wherein the item of jewelry can be pulled away from the display pad for examination by a customer.

3 Claims, 6 Drawing Sheets

JEWELRY DETENTION SYSTEM AND METHOD

This application is a continuation-in-part of and claims priority to U.S. patent application Ser. No. 12/931,690, filed Feb. 8, 2011.

BACKGROUND OF THE INVENTION

1. Field of the Invention

The invention relates generally to the field of product display systems and devices. In particular, the invention relates to a method and system for displaying jewelry to potential purchasers.

2. Description of Related Art

The prior art includes jewelry display cases and boxes that allow customers to see jewelry items that they may wish to purchase. Conventional jewelry display cases are constructed from a clear material such as glass or plexiglass. Items such as rings and bracelets are placed inside the display case through a door in the back of the case, such that customers can see the jewelry but cannot touch or handle it without assistance from a salesperson. Thus, a customer that is interested in a particular item must wait for a salesperson to open the case, then typically must interact with the salesperson while they try on the item and consider a purchase. This process creates a barrier to sales and increases the cost of the seller as they must have sufficient staff present at all times to keep wait times to a minimum.

Less expensive jewelry items may be displayed outside of a jewelry case, typically in a jewelry box such as a standard ring box. Customers can then approach the counter and remove the items from jewelry box to evaluate and try them on. Unfortunately, because most of these items are quite small, shoplifters can quickly and easily pocket such items. Thus, open displays present a significant risk of loss to the seller, particularly for smaller items such as rings and bracelets. In addition, consumers are generally not concerned with returning items to their correct location on the display, so the sales staff must carefully tag each individual item and must constantly re-organize the display.

Thus, existing methods and systems for displaying jewelry are labor intensive and inefficient. The present invention overcomes these problems, providing a method and system for securely displaying jewelry such that customers can handle and even try on various items quickly and easily.

SUMMARY OF THE INVENTION

A device for displaying jewelry comprising a retractable cord positioned beneath a jewelry display pad, wherein the cord passes through a slot in the display pad and is securely attached to an item of jewelry to be displayed on the display pad, and wherein the item of jewelry can be pulled away from the display pad for examination. In an exemplary embodiment of the invention, the retractable cord is a component of a retractable reel device which may be attached to a detention base. In another exemplary embodiment of the invention, the retractable reel device is attached to a support member on the bottom surface of the detention base and the cord passes through an aperture in the detention base. In an exemplary embodiment of the invention, the retractable reel device is attached the support member by a belt clip, and the belt clip may be held in position by one or more positioning flanges.

DETAILED DESCRIPTION OF THE PREFERRED EMBODIMENTS

Figure 1:
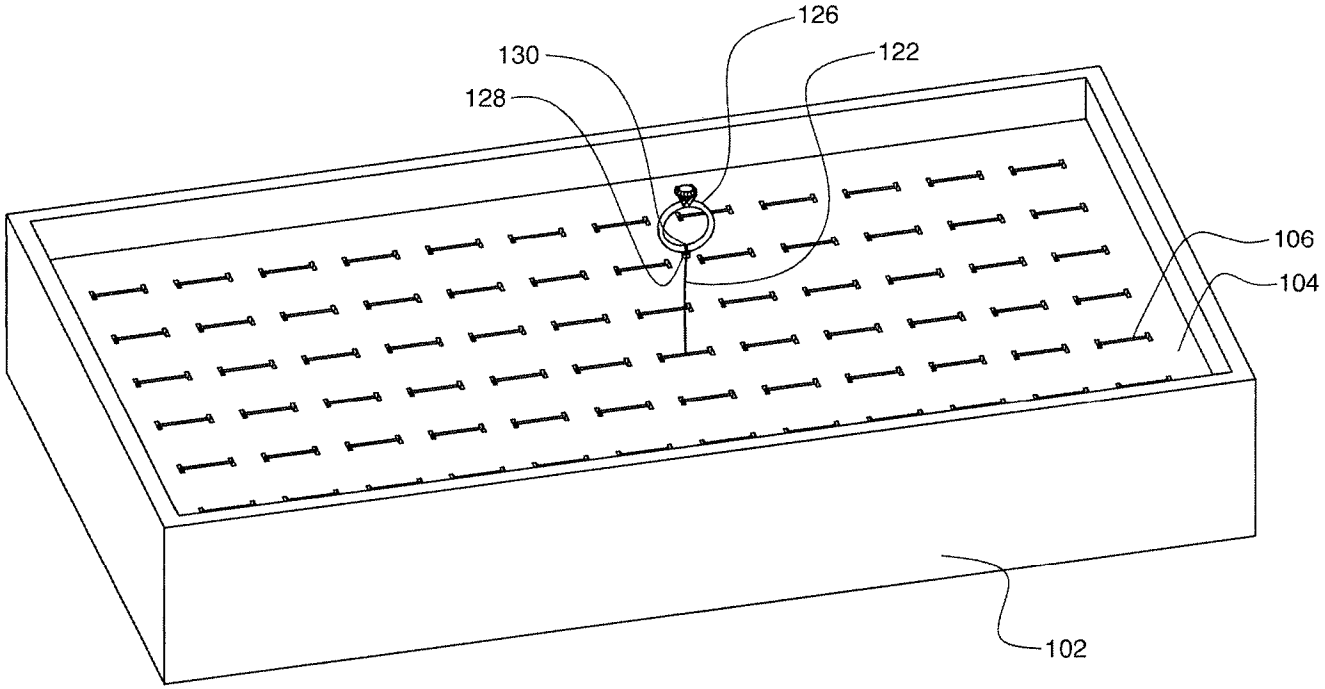
FIG. 1 is a diagram showing an exemplary embodiment of a jewelry detention system described herein with the retractable cord partially extended.
Figure 2:
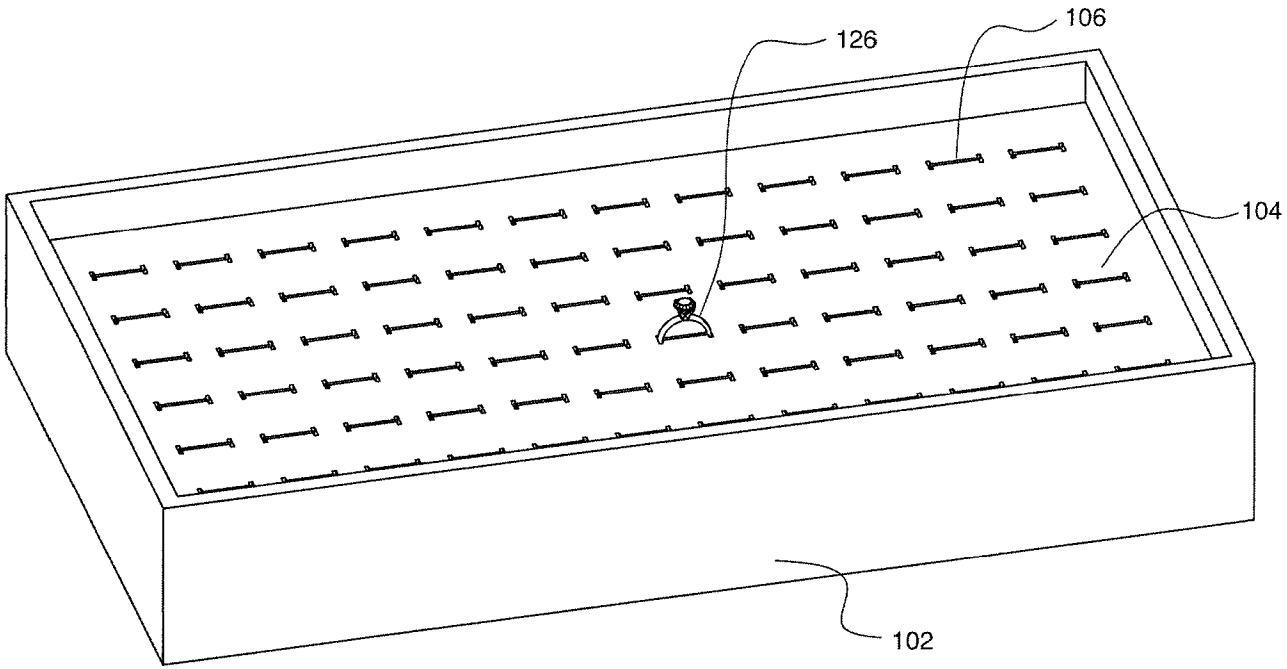
FIG. 2 is a diagram showing an exemplary embodiment of a jewelry detention system described herein with the retractable cord in a retracted position.

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Referring to FIGS. 1 through 6, a standard ring display box 102 is a rigid box with a removable or hinged cover. The box contains an insert display pad 104, typically made from foam and sometimes covered with an attractive fabric such as velvet or leatherette. The insert display pad 104 has an array of slots 106 in its surface sized to snugly hold rings for display. Each ring is pressed into a slot 106 such that the customer can see the upper half of the ring while the lower half is obscured. The depth of the display box 102 may vary to allow for storage of additional inventory below the insert display pad 104.

In an exemplary embodiment of the invention, a detention base 110 may be placed directly beneath the insert display pad 104 such that the insert display pad rests on top of the detention base 110. The detention base may be made of molded plastic or any other appropriate material. The detention base 110 has a generally planar top surface 112 with an array of apertures 114 arranged such that the apertures are aligned with the slots 106 in the insert display pad 104. On the bottom surface 108 of the detention base 110, an array of support members 116 extends downward. In an exemplary embodiment of the invention, the support members 116 are substantially parallel relatively thin members extending generally normal to the plane of the bottom surface 108. As seen most clearly in FIG. 4, the support members 116 are arranged such that a portion of a support member 116 is adjacent to each aperture 114.

In an exemplary embodiment of the invention, retractable reel devices 118 such as those commonly referred to as badge reels or key caddies that come equipped with a belt clip 120 are clipped onto the support members 116 such that the cord 122 is aligned with the aperture 114. In such an embodiment, the thickness of the support members 116 is sized to snugly accommodate a standard belt clip 120. The side of the support member 116 adjacent to each aperture is relatively smooth, such that the reel device 118 rests securely against it. The side of the support member 116 distal to each aperture 114 may have two small positioning flanges 124 aligned with the aperture 114 to further secure the belt clip 120 on the reel device 118 and insure that the reel device maintains proper alignment with the aperture 114. Cord 122 passes through the aperture and is fastened to the item of jewelry to be displayed at that position, such as ring 126. The support members 116 can take a wide variety of shapes and arrangements in order to position the retractable reel devices 118 correctly with respect to the apertures 114. Apertures 114 may be arranged in any patterns or positions appropriate to the display.

The cord 122 may be fastened to the ring 126 using any method that is secure and sufficiently small to allow it to pass through the slot 106 in the insert display pad 104. In one exemplary embodiment, the cord 122 has a small block or bead 128 at the end. This block or bead 128 can be passed through the ring 126 and passed a short distance back down the cord 122. A standard small zip tie 130 or similar fastener can then be fastened tightly around the two segments of cord 122 immediately adjacent to the ring 126 and the loose end of the zip tie 130 can be clipped close. The block or bead 128 at then end of the cord 122 will prevent the cord from slipping back through the zip tie 130 or other fastener, securely fastening the ring 126 to the cord 122.

In use, the display box 102 is placed on a counter accessible to customers and appears exactly like any standard display box. When a customer selects an item such as a ring 126, they simply pull it from the insert display pad 104 and try it on. Because only a fine gauge cord 122 is within the inner diameter of ring 126, the customer can put the ring on without any interference and evaluate its appearance. When finished, the item is naturally returned to its proper location in the display box 102 as the cord 122 is refracted by the retractable reel device 118.

The exemplary embodiments described above use commercially available retractable reel devices 118 that clip onto the support members 116 on the bottom surface 108 of the detention base 110. Use of such commercially available reel devices provides some advantages because such devices are simple, universally available, largely interchangeable, and inexpensive. However, it will be readily understood by those of skill in the art that any retractable reel system could be attached to or incorporated into the detention base in practicing the invention. Customized systems that are more robust may be suitable for higher value products. Such systems might use fixed retraction systems and high strength materials throughout, particularly for the cord and attachment mechanisms. In another exemplary embodiment, a reel device may be attached or incorporated directly or indirectly to the base of the display box or the top surface of a detention base.

Figure 3:
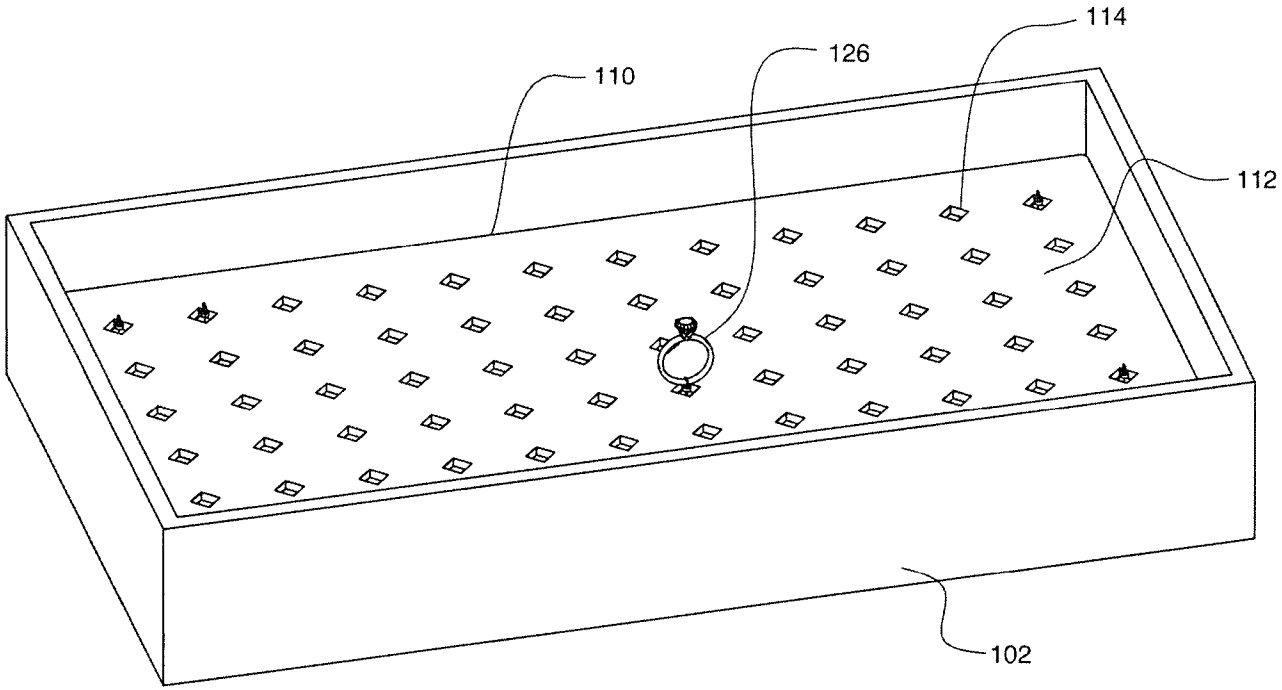
FIG. 3 is a diagram showing an exemplary embodiment of a jewelry detention system described herein with the display pad removed so the detention base is visible.
Figure 4:
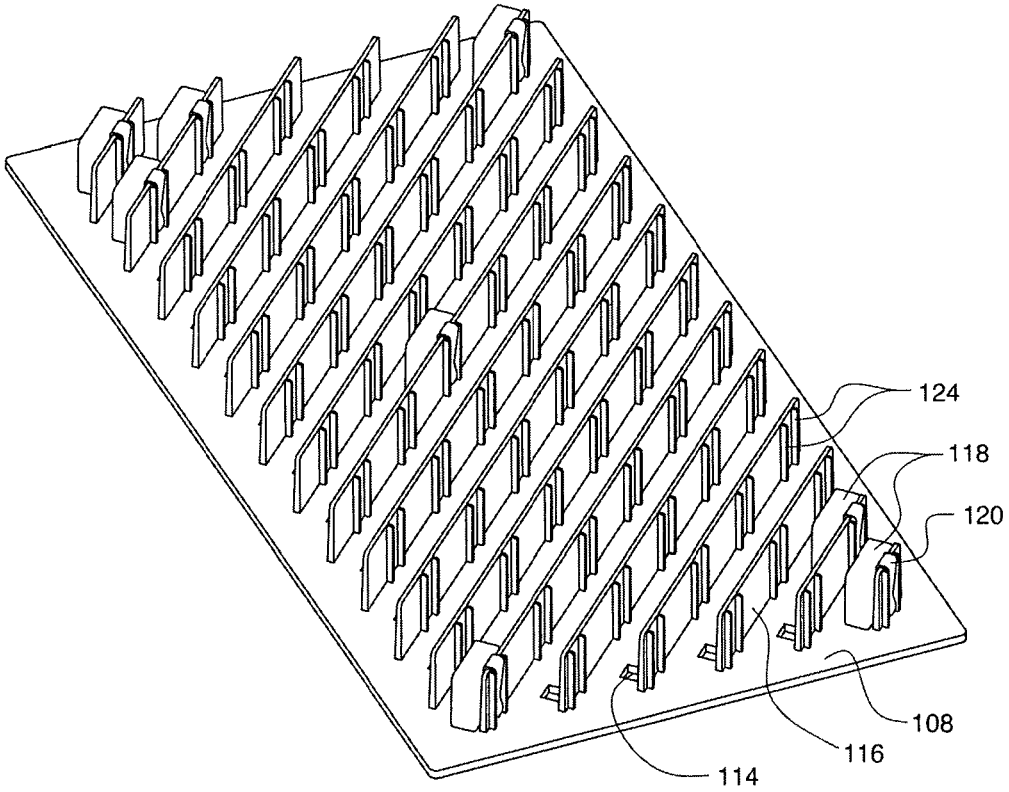
FIG. 4 is a diagram showing an exemplary embodiment of the underside of the detention base for a jewelry detention system as described herein.
Figure 5:
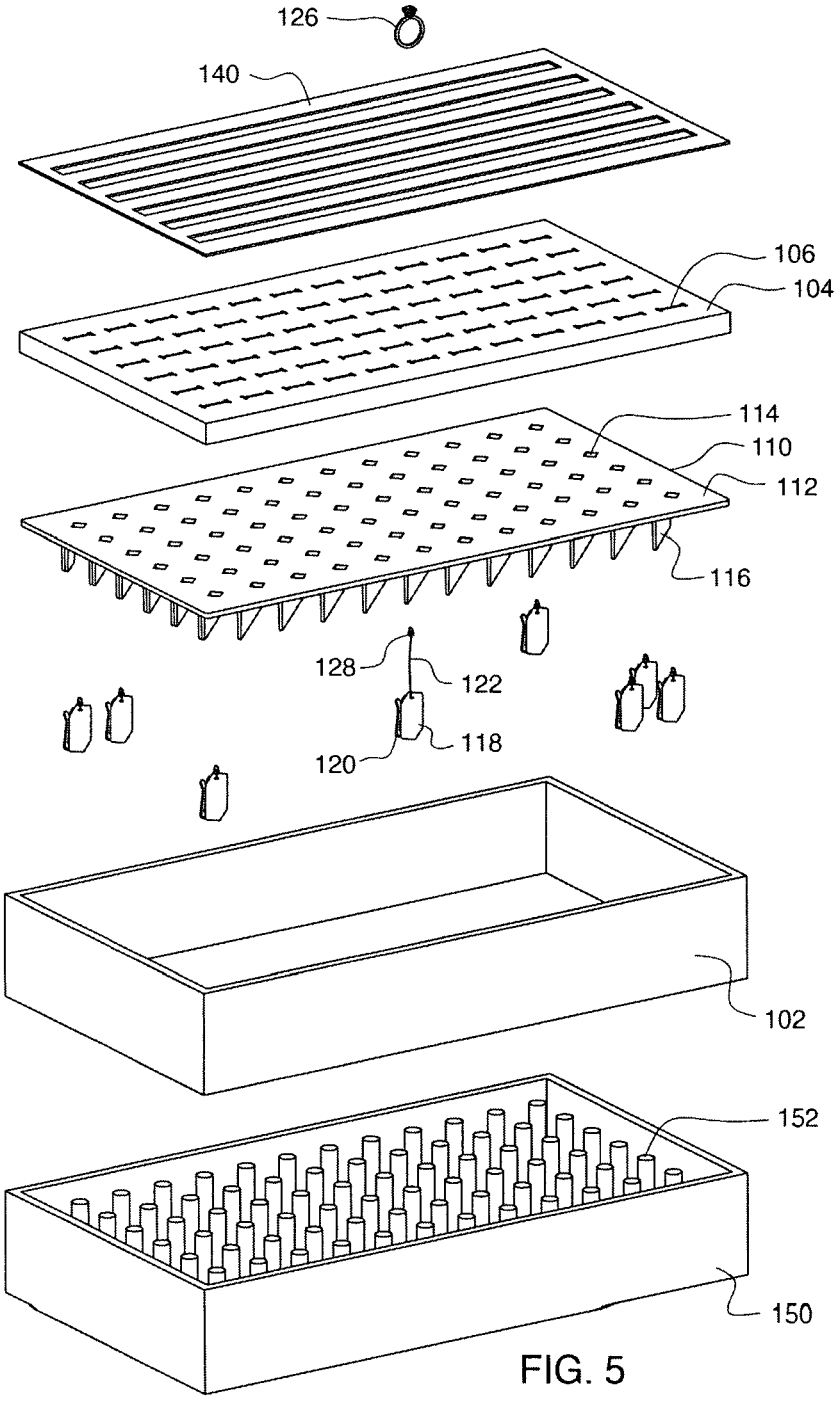
FIG. 5 is a diagram showing an exploded view of an exemplary embodiment of a jewelry detention system described herein.
Figure 6:
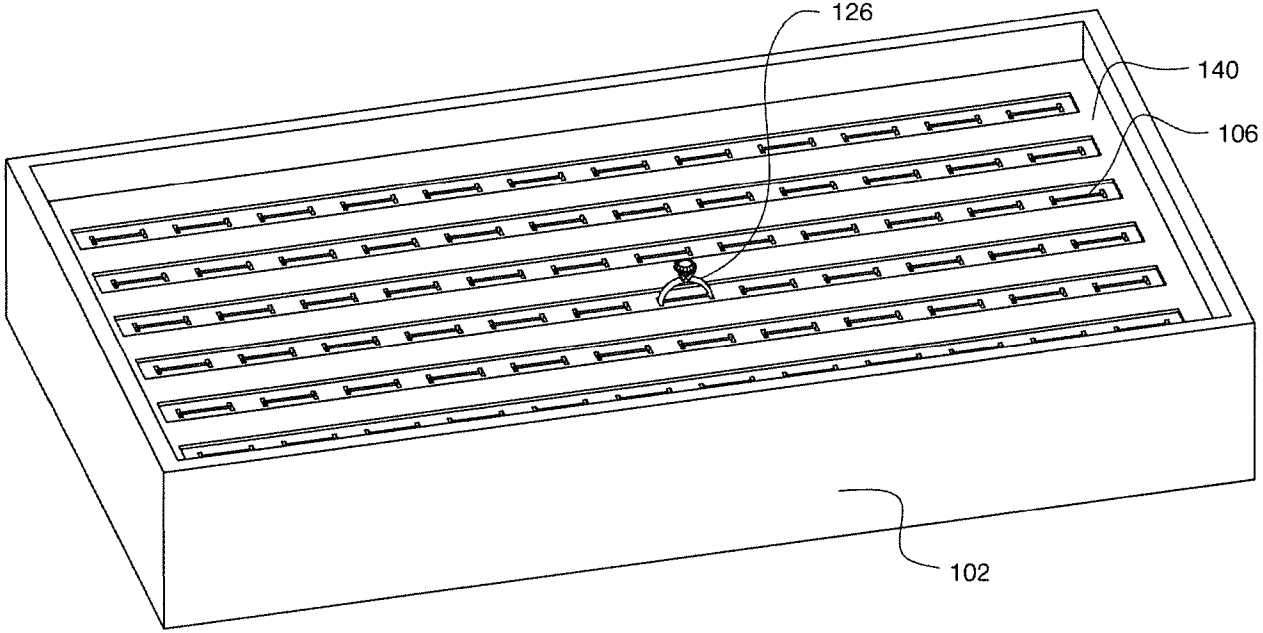
FIG. 6 is a diagram showing an exemplary embodiment of a jewelry detention system described herein with the retractable cord in a retracted position.

As shown in FIGS. 3 and 5, the apertures 114 through the detention base 110 are distributed in an array that is equally spaced to align the apertures 104 with the slots 106 in the insert display pad 104. Where the apertures are distributed uniformly such as this, in one exemplary embodiment the support members 116 are aligned at a forty-five degree angle to the sides of the rectangular detention base 110. This arrangement allows for the most efficient use of the space such that a commercially available retractable reel device 118 can be attached in alignment with each aperture 104 and associated slot 106 in the insert display pad 104.

In another exemplary embodiment, the slots 106 in the insert display pad 104 are unequally spaced or sized, or extend the entire length of the display box 102. The support members 116 may be aligned in any configuration such that a retractable reel device can be positioned below any appropriate display location. For example, if the insert display pad 104 has slots 106 that extend the entire width of the display box 102, the support members 116 may extend the width of the display box and be positioned parallel to, and slightly offset from, the slots 106 such that retractable reel devices 118 can be placed at any location along the slots 106. In this way, jewelry items of various sizes such as rings and bracelets can be displayed in the same box using the invention herein.

In various exemplary embodiments, the display pad and detention base may be integrated into a combination display pad and detention base, or the detention base itself may serve as the display surface. In one exemplary embodiment, the display pad may be replaced by a thin layer of material on the top surface of the detention base. In an alternative exemplary embodiment, the top of the detention base may be a hard display surface. Such surface may incorporate depressions, slots, or other geometries to form individual display positions for the jewelry item being displayed.

It will be readily understood by those skilled in the art that the location and arrangement of the retractable reel devices and any support members can be varied as necessary depending on the size and shape of the display box, and to accommodate any display layout desired.

In another exemplary embodiment shown in FIG. 5, a ring inventory container 150 is placed below or behind display box 102 such that product inventory can be easily accessed and maintained. For example, a box containing a set of vertical dowel rods 152 aligned with the display positions for products displayed in display box 102 can be placed underneath display box 102. For each item displayed in display box 102, an inventory of the same items can be placed on the dowel rod 152 below its location. When a customer has selected an item, the salesperson can simply lift up the display box 102 and remove the item from the inventory below for packaging and presentation to the customer. In this way, it is simple for the salesperson to obtain the merchandise and there is no need to replace the display ring 126 and re-attach a new ring to the cord 122. In an alternative exemplary embodiment, the display box 102 may be placed on the counter vertically or at an angle with the display items facing the customer. The inventory container 150 containing the dowel rods 152 can be placed on the counter vertically or at a similar angle facing toward the sales person, such that the salesperson has immediate access to the inventory of the items displayed to the customer.

The method and system for displaying jewelry described herein provides a better customer experience and reduces labor costs associated with tagging and sorting items and maintaining displays. It further improves sales by providing immediate access to customers and by allowing them to handle the jewelry items without the need to have a salesperson present.

What is claimed is:

1. A device for displaying jewelry comprising:

a jewelry display box;

a display surface having a plurality of receiving areas for displaying a plurality of rings;

a detention base comprising a substantially planar surface supporting the display surface, and further comprising a plurality of apertures extending through the planar surface, each aperture located at one of the plurality of receiving areas;

the detention base further comprising a plurality of support structures extending downward from the substantially planar surface;

a plurality of retractable cords affixed to the support structures and positioned such that each cord passes through one of the plurality of apertures and is securely attached to an item of jewelry to be displayed;

wherein each retractable cord extends from a retractable reel device attached to a support structure of the detention base; and a ring inventory container that can be positioned below or behind the display surface;

the ring inventory container comprising a box having a set of vertical rods aligned with the receiving areas for displaying a plurality of rings.

2. A device for displaying jewelry comprising:

a jewelry display box;

a display surface having a plurality of receiving areas for displaying a plurality of rings, and a plurality of apertures extending through the display surface, each aperture located at one of the plurality of receiving areas;

the display surface further comprising a plurality of support structures extending downward from the display surface;

a plurality of retractable cords affixed to the support structures and positioned such that each cord passes through one of the plurality of apertures and is securely attached to an item of jewelry to be displayed, wherein each retractable cord extends from a retractable reel device attached to a support structure;

a ring inventory container that can be positioned below or behind the display surface;

the ring inventory container further comprising a box having a set of vertical rods aligned with the receiving areas for displaying a plurality of rings.

3. A device for displaying jewelry comprising:

a jewelry display box;

a display surface having a plurality of receiving areas for displaying a plurality of rings;

a detention base comprising a substantially planar surface supporting the display surface, and further comprising a plurality of apertures extending through the planar surface, each aperture located at one of the plurality of receiving areas;

a plurality of retractable cords located below the detention base and positioned such that each cord passes through one of the plurality of apertures and is securely attached to an item of jewelry to be displayed;

wherein each retractable cord extends from a retractable reel device; and a ring inventory container that can be positioned below or behind the display surface the ring inventory container further comprising a box having a set of vertical rods aligned with the receiving areas for displaying a plurality of rings.

* * * * *